United States Patent [19]

Lomedico

[11] Patent Number: 4,461,043

[45] Date of Patent: Jul. 24, 1984

[54] BATTING ACCESSORY

[75] Inventor: Philip R. Lomedico, Bardonia, N.Y.

[73] Assignee: RI Consultants, Inc., Harrison, N.Y.; a part interest

[21] Appl. No.: 397,604

[22] Filed: Jul. 12, 1982

[51] Int. Cl.[3] ..... A41D 13/00

[52] U.S. Cl. ..... 2/21; 2/16; 2/161 A; 273/24; 273/26 C

[58] Field of Search ..... 2/163, 17, 20, 21, 161 R, 2/16, 161 A, 167, 158; 128/157, 89 R; 273/24, 26 C

[56] References Cited

U.S. PATENT DOCUMENTS

| | | | |
|---|---|---|---|
| 1,200,580 | 10/1916 | Brenner | 2/20 |
| 1,483,595 | 2/1924 | Read | 2/21 |
| 2,637,031 | 5/1953 | Friedman | 2/21 |
| 2,651,776 | 9/1953 | Beatty | 2/16 |
| 2,670,736 | 5/1954 | Dunkelberger | 2/21 |
| 2,797,687 | 7/1957 | Crawford | 128/157 |
| 2,999,243 | 9/1961 | Gross et al. | 2/21 |

FOREIGN PATENT DOCUMENTS

| | | | |
|---|---|---|---|
| 139400 | 3/1920 | United Kingdom | 2/16 |

OTHER PUBLICATIONS

European Patent #0064432, Genzling Published 10-1-1-1982.

*Primary Examiner*—Henry Jaudon
*Assistant Examiner*—Tracy Graveline
*Attorney, Agent, or Firm*—Gottlieb, Rackman & Reisman

[57] ABSTRACT

A baseball batting accessory in the form of a cushioning pad having a flap portion to protect the batter's hands against bone bruises and to properly position the bat near the batter's fingertips.

9 Claims, 5 Drawing Figures

FIG. 1
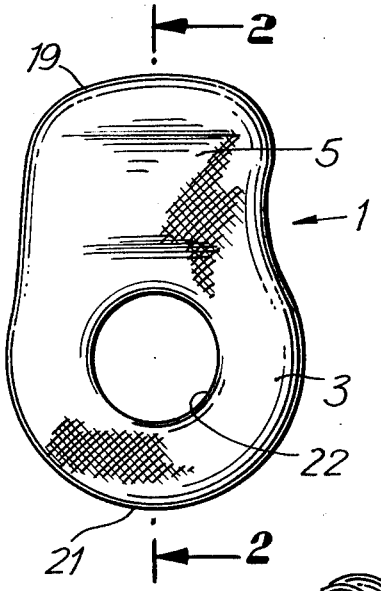
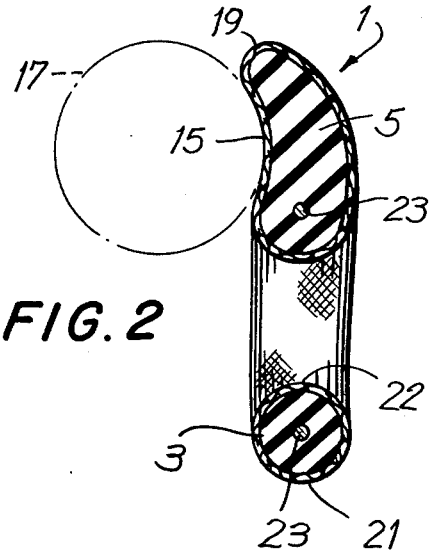
FIG. 2
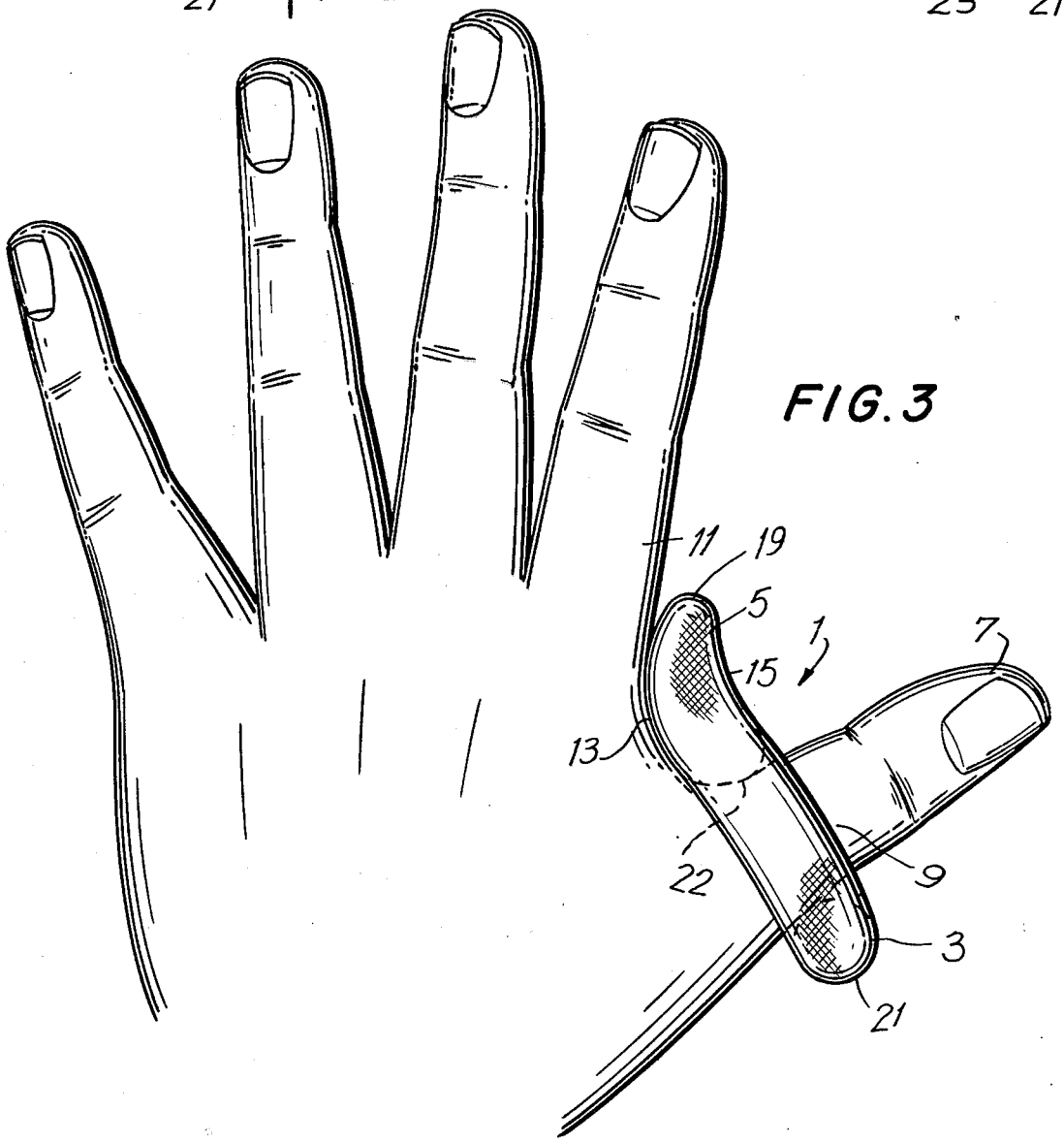
FIG. 3

BATTING ACCESSORY

This invention relates generally to baseball accessories for protecting a batter's hands against injury and for aiding the batter's control of the bat.

BACKGROUND OF THE INVENTION

When a batter in a baseball game hits a ball off the thin part of his bat toward the area where he takes his grip, a strong shock is sent to the batter's hand, which can cause bruises of the bones of the thumb, and index finger and the soft cradle of tissue lying between the thumb and index finger. These bruises are easily aggravated and quickly become a painful and recurring problem for batters. Once a batter's hand sustains such a bruise, it becomes more sensitive to further shocks which very often causes the batter unknowingly to become less aggressive and hence a less effective batter. The severity of repeated injury to the bruised area and constant trauma also interrupts the healing process.

Even long after the bruise has healed the batter's stroke can be adversely effected. Subtle changes induced by compensating for the injury, which are often difficult to detect or correct may detrimentally affect the batter's performance in a manner that passes undetected by even a competent coach.

Batters are normally instructed to hold the bat near their fingertips (for example by the last two digits) in order to obtain much greater control of the bat and therefore to enhance their ability to make better contact with the ball. This is generally a difficult instruction for batters to follow and batters typically allow the bat to rest deep in the cradle between the thumb and index finger, which gives a false psychological feeling of improved control over the bat and of greater hitting power.

It's known in the prior art for batters to employ batting gloves, however, none are known which protect the area of concern with respect to batter's bone bruises. For example, U.S. Pat. No. 4,176,407 discloses a padded protective device to protect the palm and back of the wearer's hand and suggest that such may be worn by players of such games as volleyball. The '407 patent stresses that the device it disclosed does not impede the use of the player's fingers and thumb. In fact the device has a thumb hole that is placed in a portion spaced away from the padding so that no significant protection is afforded the thumb-finger cradle area.

U.S. Pat. No. 1,465,223 discloses a padded handsand or protector for baseball players. However, this is designed to protect the ballplayer from the impact of a caught ball and did not appreciate nor attempt to solve the problems addressed by the present invention. In particular all its padding is in the palm area of the device where it provides no protection for the batter.

U.S. Pat. No. 3,501,773 discloses an athletic glove for baseball players. However, this is designed only to control the wrist action of the players and does not provide any significant protection to the thumb-finger cradle area.

U.S. Pat. No. 2,738,190 discloses a pad for bowlers. The disclosed purpose of this pad is merely to fill the space that occurs between the bowler's palm and the ball in the specialized grip that bowlers employ. This pad could not be of use to batters because it would not afford the protection needed in the thumb-forefinger cradle area and if used would dispose the bat at an awkward angle deeply into the thumb finger cradle, which would worsen the batter's hitting performance, i.e. it would emphasize palm control at the expense of fingertip control. U.S. Pat. No. 3,496,573 discloses a similar palm covering and suggests its use for several sports including baseball, but only in connection with baseball control. It would be inappropriate for employment by batters for the same reasons as stated for the pad of the U.S. Pat. No. 2,738,190 patent.

U.S. Pat. No. 1,887,278 discloses hand protectors for golfers. These however are designed only to protect against abrasion of a twisting club. They could not protect or aid a baseball batter in the manner of the present invention.

U.S. Pat. No. 1,690,312 describes a clip device for attachment to a golf club during training only to teach a proper grip. There is no protective cushioning associated with that device because there is no impact problem at the golfers hands because a golf club always strikes the ball with the head of the club. The device is also designed to impede and not enhance fingertip control of the club.

Copies of each of the foregoing patents are enclosed.

In none of this prior art then is there an appreciation of the problem of thumb-index finger cradle protection solved by the present invention nor is an apparatus disclosed that would be useful for the baseball batter.

The conventional batting glove is customarily designed only to enhance friction between the batter's hands and the bat. Batting gloves are customarily worn under an outfielder's or an infielder's fielding glove. Any permanent padding built into a batting glove would tend to interfere with fielding. It would prove to be bulky and uncomfortable interfering with the secure grasp executed while catching the ball. Furthermore, some batters prefer not to wear batting gloves.

BRIEF DESCRIPTION OF THE PRESENT INVENTION

With the foregoing considerations in mind, the present invention contemplates a cushioning and spacing apparatus capable of protecting a baseball batter from bruises of the bones of the thumb and index finger and bruises of the soft cradle of tissue lying between the thumb and index finger and for assisting the batter to retain the bat during his swing in the portion of his hand towards his fingertips (for example the last two digits of each finger) thereby giving greater control of the bat and enhancing the batter's ability to make better contact with the ball.

It is the purpose of the present invention to provide an apparatus which protects the baseball batter from bone bruises of the bones of the thumb and index finger and the cradle of soft tissue between both fingers.

It is a further purpose of this invention to provide an apparatus that forces the batter to grip the bat with his fingertips giving him greater control of the bat. Thirdly, it is a still further purpose of this invention to provide such apparatus adapted to be worn on either hand without or over a batting glove or to be specifically shaped to be built onto the batting glove.

BRIEF DESCRIPTION OF THE DRAWINGS

A better understanding of this invention will be had by reference to the accompanying drawings in which FIG. 1 is a top view of a preferred embodiment of the invention.

FIG. 2 is a cutaway side view of the same preferred embodiment of the invention, FIG. 3 depicts the same preferred embodiment in place on the batter's hand.

DETAILED DESCRIPTION OF A PREFERRED EMBODIMENT

Figure 4:
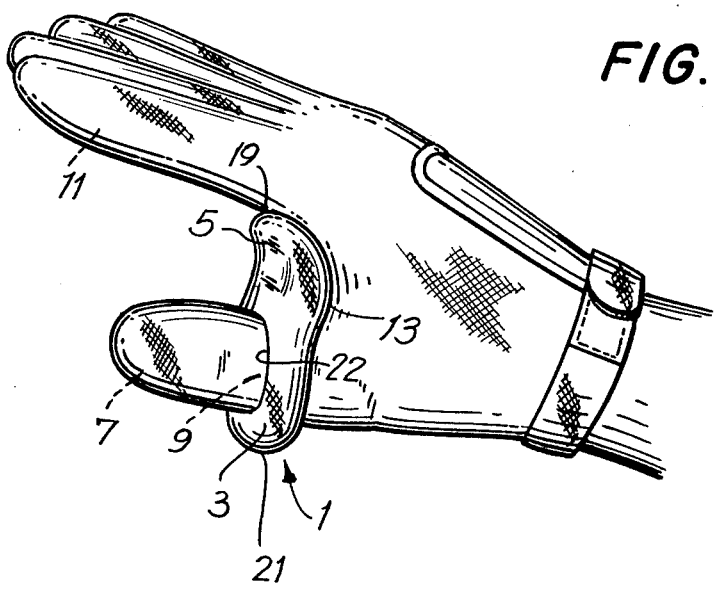
FIG. 4 is a perspective view depicting the same preferred embodiment in place on a batter's hand over a batter's glove or attached as part of the batting glove.

FIG. 1 shows a preferred embodiment of the invention as a batting pad shown generally as 1, preferably made of a firm flexible plastic or foam rubber material having the shape of a ring portion 3 surrounding a wire core 23 and having a flexible elongated portion 5. The ring portion 3 is adapted to fit over the batter's thumb 7, as shown in FIG. 3 with a flexible firm elongated member 5 adapted to fit closely and rest at the base of the thumb 9 and index finger 11 at the cradle area between the thumb and forefinger generally indicated as 13. The area 13 and the base of the thumb and forefinger is the delicate area which is susceptible to bone bruises. As indicated in the cutaway side view, FIG. 2, and the perspective view FIG. 3, it is preferable that the flap 5 be concave in the same direction as the natural curve of the batter's hand and have a portion 15 adapted to contact the bat 17.

The batting pad may be made in different sizes so that it may be used by youth or little league, intermediate or Babe Ruth League, and adult or professional league players. Roughly, for adult size the dimensions of the batting pad are preferably as follows: The total length measured from the tip 19 of the flap 5 to the remote edge 21 of the ring 3 as shown in FIGS. 1 and 2 is approximately two-and-a-half (2-½) inches. The interior diameter of the ring 3 as shown in FIG. 1 is approximately one (1) inch. The length of the flap is approximately one (1) inch. The width of the device in this preferred embodiment is approximately one-and-a-half (1-½) to one-and-three-quarter (1-¾) inches measured across its widest parts. The accuracy of these dimensions is approximately to the nearest ½ inch and may be scaled down for younger players by a factor which is the size of their finger width relative to that of an adult. The core 23 is made of a stiff flexible wire that permits the ring to be deformed to fit different size hands within each size range so that the foregoing dimensions are not critical. The material of which the pad is made, may be a cushioning rubber or porous plastic material that can be selected by persons skilled in this art taking into account at least two factors. First it should be sufficiently thick and shock absorbent to offer the protection required for the bones of the hand. This of course may be simply determined by those familiar with the stiffness and bulk modulus of the semi-hard material that is employed for the fabrication of the device. Secondly, the pad should be designed to provide the second advantage of this invention, namely, the pre-compressed thickness should cause the batter to properly space the bat away from the junction of the index finger and thumb towards the fingertips to enable greater control of the bat. A preferred thickness in the region 15 where the bat rests in approximately ¾ of an inch for a pad made of plastic foam material.

The shape of the device is not critical so long as it is designed to fit comfortably in the hands of the batter and provide the foregoing advantages. A preferred embodiment is shown in FIGS. 1, 2 and 3 to be narrower in the region of the junction of the index finger and thumb and wider in the region surrounding the thumb.

In this preferred embodiment, the batting pad comprises an elongated member having the thumb receiving aperture 21 at the end thereof and the portion 5 having a semi tear drop configuration shown in FIG. 2.

Figure 5:
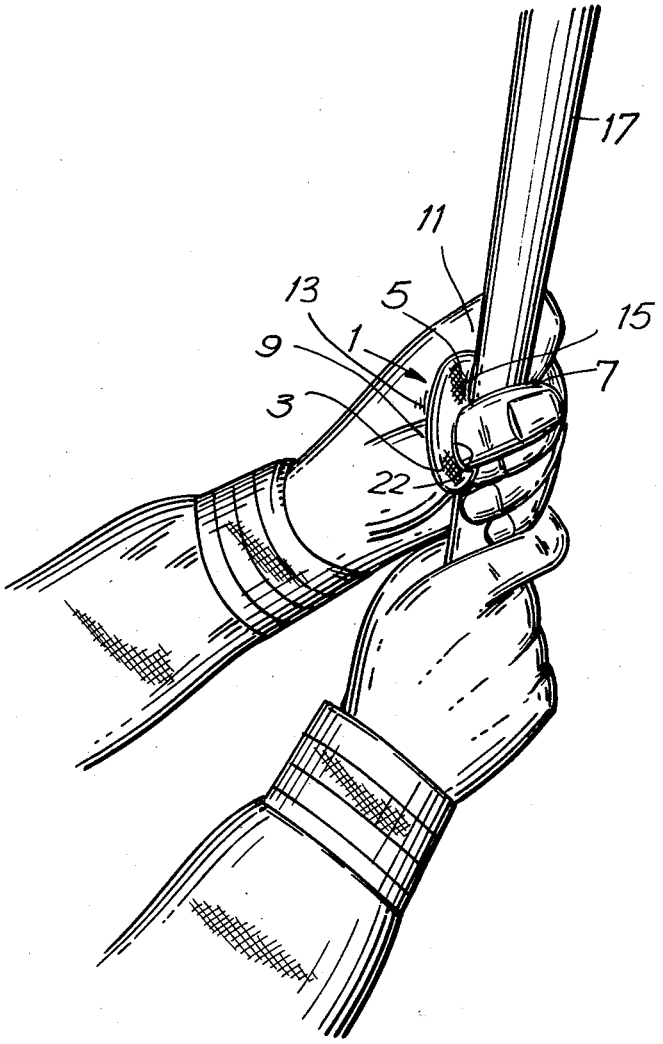
FIG. 5 is a perspective view depicting the preferred embodiment in place in a batter's standard gripping position.

In use a right handed batter simply places the pad on his right hand. FIG. 4 and FIG. 5 show the batting pad properly positioned for use. FIG. 4 indicates its use together with the batting glove and FIG. 5 shows the use of a bare hand grasping a bat.

FIG. 5 shows the present invention in its preferred embodiment as it is used by a batter in the correct gripping position. It can be seen in FIG. 5, the manner in which the batting pad protects the location 13 of the junction of the thumb and the forefinger and at the same time requires the batter to curl his fingers further around the bat thereby encouraging fingertip contact with the bat.

It is also within the scope of this invention to design the pad so that it is retained by a portion of the hand other than the thumb or to employ a U-shaped portion to only partly surround the thumb.

Although in the above-mentioned preferred embodiment a specific configuration for the batting pad is shown, other dimensions, materials and shapes may be given to the batting pad while still coming within the scope of the present invention. It is not intended by the description of a preferred embodiment to limit the scope of the definition of the invention which is understood to include all those equivalent shapes and structures which will accomplish the same benefits as the present invention.

What is claimed is:

1. A batting pad comprising an elongated member made of a cushioning material and having a ring portion adapted to fit over a batter's thumb and a flap portion extending therefrom, said flap portion having a curvature similar to the natural curve of a batter's hand so as to rest upon the cradle area between the batter's thumb and index finger.

2. A batting pad according to claim 1 wherein said flap portion has a semi-tear drop configuration adapted to fit closely to the cradle area between the batter's thumb and index finger when held in hitting position by the batter.

3. The batting pad according to claims 1 or 2 wherein the flap portion has sufficient thickness so that a baseball bat held in hitting position by a batter employing said batting pad is gripped by the two digits of the fingers closet the fingertips fo the hand employing said batting pad.

4. A batting pad according to claim 2 wherein said pad has a length of about 2-½ inches and a width of about 1-½ inches, said ring has an inner diameter of about 1 inch, and said pad has a thickness of about ¾ inch.

5. A batting pad according to claim 2 wherein said flap portion has a portion of its surface curved to receive the shaft of a bat.

6. A batting pad for use by a baseball batter comprising a portion adapted to fit over the batter's thumb and a flap portion made of a cushioning material extending therefrom wherein said flap portion has a curvature similar to the natural curve of a batter's hand to fit the contour of the batter's hand and to rest on the soft tissue cradle between the batter's thumb and index finger.

7. The batting pad of claim 6 wherein the flap portion has a semi-tear drop configuration and is sufficiently thick to prevent a batter wearing said batting pad from gripping a bat by the inner portion of the fingers away from the fingertips.

8. A batting pad comprising an elongated member made of a cushioning material and having a ring portion adapted to fit over a batter's thumb and a flap portion extending therefrom, said flap portion having a semi-tear drop configuration adapted to fit closely to the cradle area between the batter's thumb and index finger and having a thickness of about $\frac{3}{4}$ inch so that a baseball bat held in hitting position by a batter employing said batting pad is gripped by the two digits of the fingers closest to the fingertips of the hand employing said batting pad, said flap portion further having a portion of its surface curved to receive the shaft of a bat, said batting pad having a length of about 2-$\frac{1}{2}$ inches and a width of about 1-$\frac{1}{2}$ inches and said ring having a inner diameter of about 1 inch.

9. The batting pad of claim 8 wherein the ring has a central wire core.

* * * * *